United States Patent [19]

Hayakawa

[11] 4,025,778

[45] May 24, 1977

[54] FOCUSING DEVICE FOR SEALED TYPE MULTI-LAMP FOR OBTAINING SHADOWLESS ILLUMINATION

[75] Inventor: Yoshito Hayakawa, Kounosu, Japan

[73] Assignee: Yamada Iryo Shomei Kabushiki Kaisha, Tokyo, Japan

[22] Filed: Oct. 14, 1975

[21] Appl. No.: 622,400

[30] Foreign Application Priority Data

May 28, 1975 Japan ..... 50-63035

[52] U.S. Cl. ..... 240/1.4; 240/41.15

[51] Int. Cl.[2] ..... A61G 13/00; F21V 33/00

[58] Field of Search ..... 240/1.4, 41.15, 44, 240/9 R

[56] References Cited

UNITED STATES PATENTS

| | | | |
|---|---|---|---|
| 1,700,590 | 1/1929 | Lazar | 240/1.4 |
| 3,225,184 | 12/1965 | Reiber | 240/1.4 |
| 3,375,362 | 3/1968 | Klippert | 240/1.4 |
| 3,887,801 | 6/1975 | Ilzig et al. | 240/1.4 |

*Primary Examiner*—John Gonzales

*Attorney, Agent, or Firm*—Wenderoth, Lind & Ponack

[57] ABSTRACT

A multi-lamp shadowless illumination system which has a plurality of sealed lamp housings and a lamp tiltably mounted in each lamp housing. The lamp housings are mounted on a lamp holding pipe means in a generally horizontal array and in positions with the axes of the lamps directed toward a light axis depending perpendicularly from the central point of the array of lamp housings, the lamps within said housings being tiltable around axes which are perpendicular to the light axis.

Operating rods are movable linearly within the pipe means and have one end operatively coupled with the respective lamps for tilting the lamps. Gear means is coupled to the operating rods for driving the rods for simultaneously tilting the lamps to move the focal point of the beams of light from the lamps along the light axis.

8 Claims, 8 Drawing Figures

FOCUSING DEVICE FOR SEALED TYPE MULTI-LAMP FOR OBTAINING SHADOWLESS ILLUMINATION

This invention relates to a multi-lamp shadowless illumination system having sealed lamps, and more particularly relates to such a system in which the lamps can be simultaneously adjusted.

BACKGROUND OF THE INVENTION

There are conventionally two types of multi-lamp shadowless illumination systems used in medical environments. One is a single lamp housing type in which a number of lamps are mounted in a single lamp housing. The other is a multi lamp housing type in which a number of lamps are sealed within separate lamp housings which in turn are linked together by a connecting pipe.

In the single lamp housing type, the depth of focus of the system, i.e. distance from the lamps of the point at which the axes of the lamp converge, is adjusted by tilting each lamp within the lamp housing. As far as the inventor is aware, however, the depth of focus in a multi-lamp housing type is fixed, and there is no system of this type available which is equipped with a lamp-tilting device to change the focal depth.

Recently the use of the so-called "clean air" type operating rooms, which are freed from bacteria and dust by discharging dirty air and introducing clean air, has been increasing. In such rooms single lamp housing type illuninating systems using a bulky lamp housing are not desirable. The reasons are that the top surface of the lamp housing is so large that dust and other deposits collect naturally on such a large area; and when clean air is introduced, the collected dust falls on the body of a patient being treated and is likely to cause a secondary infection in the patient due to a bacteria or the like.

Thus for a clean air" operating room, adoption of a multi-lamp housing type of shadowless illumination system is preferable.

However, with a multi-lamp housing type of shadow less illumination system there is the inconvenience of moving all the lamp housings to focus the light depending on the position of the patient's body, because the systems are a fixed focus type system, as stated above. Moving all the lamp housings is not only strenuous work but is also likely to cause stirring up of dust, even if in small quantities, which is undesirable from the standpoint of medical treatment or sanitation.

Thus the medical world has desired a multi-lamp housing type shadowless illumination system which is equipped with means within the lamp housing for adjusting the depth of focus by merely changing the angle of each lamp instead of moving all the lamp housings.

OBJECTS OF THE INVENTION

One object of the present invention is to provide a focusing device for a sealed multi-lamp housing type shadowless illumination system in which the focal depth of the system can be freely adjusted by adjusting the lamps without touching them with the hand, after the lamps have been properly located in their illuminating positions.

Another object of the present invention is to provide a focusing device which can adjust the focal depth of the system without causing any variance in the focus condition.

Still another object of the present invention is to provide a focusing device for a sealed multi-lamp housing type shadowless illumination system which is simply constructed and is easy to maintain and inspect.

Still another object of the present invention is to provide a sanitary focusing device of the above-described type of which does not spoil the no-bacteria, no-dust effect of a "clean air" operating room, said device being characterized in that said device is installed within the individual lamp housings and within a pipe linking all lamp housings and there is no likelihood of dust deposited on the lamp housing falling down therefrom, because the focal adjustment does not cause movement of the lamp housings.

BRIEF DESCRIPTION OF THE DRAWINGS

The present invention will be more fully described in the following detailed description with reference to the attached drawings, in which like reference numbers designate similar parts, and in which.

DETAILED DESCRIPTION OF THE INVENTION

Figure 1:
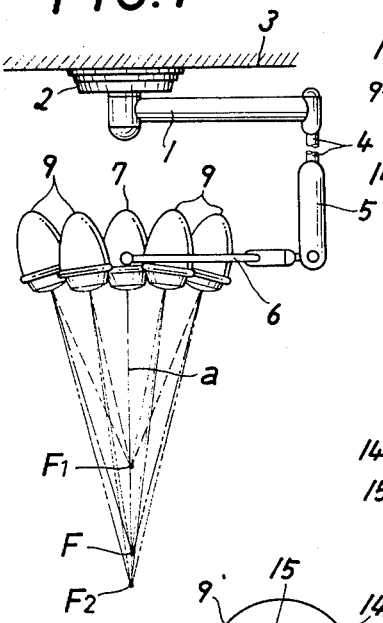
FIG. 1 is an elevational view of a nine-lamp shadow less illumination system of the present invention adapted to be mounted on a ceiling.

The nine-lamp shadowless illumination system shown in FIGS. 1, 3, 5, 6, 7 and 8 has a rotatable tubular arm 1 rotatably mounted at one end on a ceiling 3 by means of a lamp fixture 2, and a pendant tubular arm 4 is rotatably mounted on the free end of arm 1. On the lower end of said pendant arm 4 is an automatic tubular balancer 5 and pivoted thereto for movement around a horizontal axis is a lamp housing holding arm 6 consisting of a U-shaped pipe. Between the tips of said lamp housing holding arm 6 is rotatably mounted a lamp fitting pipe 8 having a central lamp housing 7 thereon.

At positions spaced equally around the center of the central lamp house 7 are eight lamp housing pipes 10, extending radially and having eight lamp housing 9 on the ends thereof. At the center within the central lamp housing 7 is a lamp holder 15 on which a lamp 11 is mounted such that its light axis A is directed perpendicularly to the plane of housing 7. Around the periphery of said lamp 11 is rotatably mounted an annular bevel gear 12. Within each lamp housing 9 is a lamp-holder 15 pivotally mounted on the housing on a pivot shaft 14 extending at right angles to the lamp housing pipe 10, and on each lamp holder is a lamp 13. Each pivot shaft 14 has a spring 16 wound thereon, one end of which is fixed to the top side of the lamp-holder 15, the other end being fixed in a spring-engaging hole 18 bored in a lamp-holder fitting 17 by which the pivot shaft 14 is mounted on the housing 9, so that each lamp 13 is urged to tilt by the force of said spring 16 so that the axis of the light beam therefrom moves toward focal point $F_2$ which is the greatest depth of focus.

Within each lamp housing pipe 10 is provided an operating rod 22, one end of which is threaded into one end of an internally threaded tubular screw gear 20 rotatably mounted in bearings in pipe 10. The other end of the tubular screw gear is attached to the center of a beveled pinion 19 meshing with the annular bevel gear 12. The other end of rod 22 bears against a lamp-tilting bearing plate 21 provided on the side surface of the lamp-holder 15.

The operating rod 22 has a key groove 22*a* therealong into which loosely fits a key 10*a* fixed to the inside of the pipe 10. Thus the operating rod is movable linearly but is not rotatable.

The lamp housing 9 is a sealed structure having approximately an egg shape including a front glass 23 at the bottom, and it is fixed by the lamp housing pipe 10 in a position inclined toward the center, i.e., in the direction of light axis A of lamp 11. It will thus be seen that the point of covergence of the axes of the light beams from lamps 13 on axis A, i.e. the focal point F, can, by tilting lamps 13, be adjusted from its minimum depth position $F_1$ to the maximum depth position $F_2$.

Electrical connection of the lamps 11 and 13 within the lamp housings 7 and 9 to a power source if effected by a cord 24 leading from each lamp 11 or 13, passing internally through each pipe 8 or 10, the lamp house holding arm 6, the automatic balancer 5, the pendant arm 4, the rotatable arm 1 and the lamp fixture 2; and connecting via a switch or the like with a power source at some point in the ceiling 3.

A focus-adjusting knob 25 is rotatably mounted at one end of the connection between the lamp house holding arm 6 and the lamp fitting pipe 8 and has a rotatable shaft 26 connected thereto and rotatably mounted within the lamp fitting pipe 8. On the other end of the rotatable shaft 26 is mounted a bevel drive pinion 27 which meshed with the annular bevel gear 12.

Figure 6:
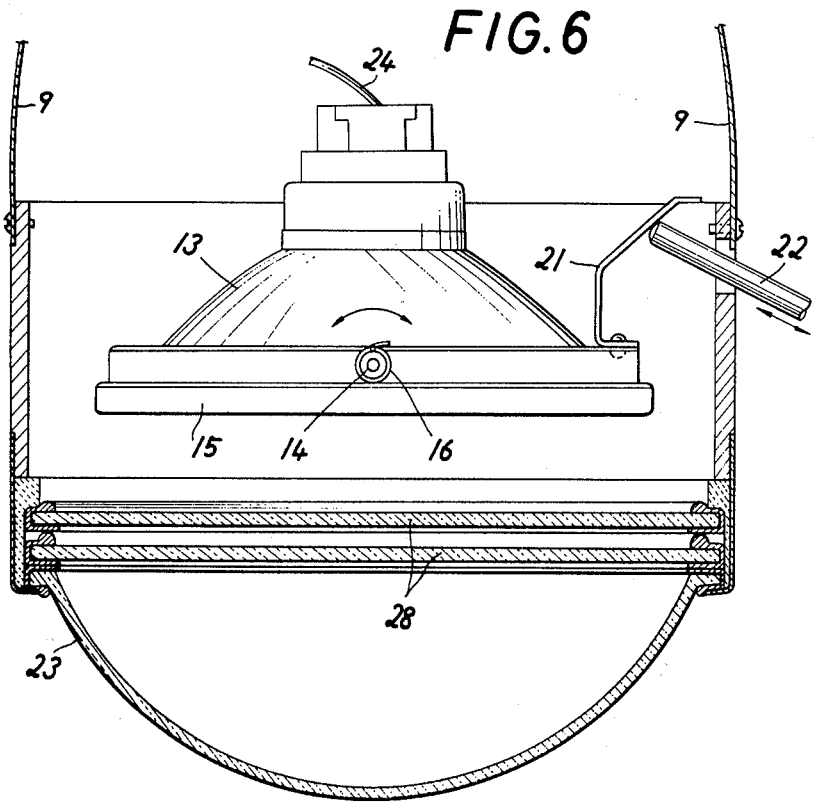
FIG. 6 is an enlarged section view of a lamp housing according to the present invention.

As illustrated in FIG. 6, infrared absorption filter 28 can be provided between the front glass 23 each lamp housing 7 or 9 and the corresponding lamp 11 or 13.

For focus adjustment, the focus-adjust knob 25 is turned, whereby the pinion 27 rotates the bevel gear 12 and pinions 19, and each operating rod 22 goes in or out of the tubular screw gear 20, depending on the direction of rotation of knob 25, thereby carrying out a linear movement as the result of being prevented from rotating by key 10*a*.

The linear movement of the operating rod 22 as it engages the corresponding bearing plate 21 causes each lamp-holder 15 to oscillate around the pivot axis 14, against the force of the spring 16 when the movement of the rod is toward the lamp, and under the force of the spring 16 when the movement of the rod is away from the lamp.

As the light beam axis of each lamp 13 moves, the location of the point of focus F changes in range from $F_1$ to $F_2$. The operator need only to stop the focus-adjust knob 25 at the position of the desired depth of focus.

Figure 2:
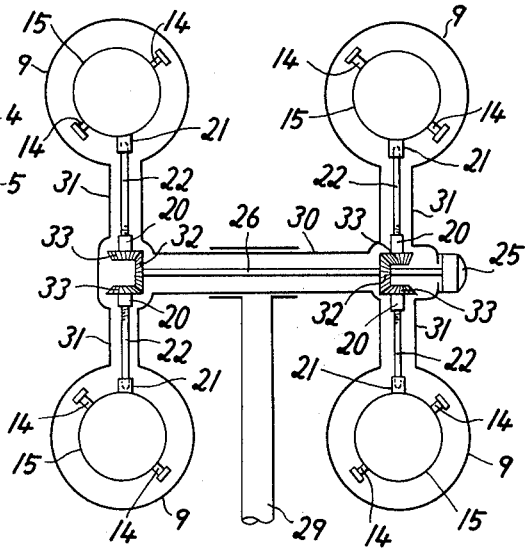
FIG. 2 is a diagrammatic plan view explaning the structure of a four-lamp shadowless illumination system according to the invention.
Figure 3:
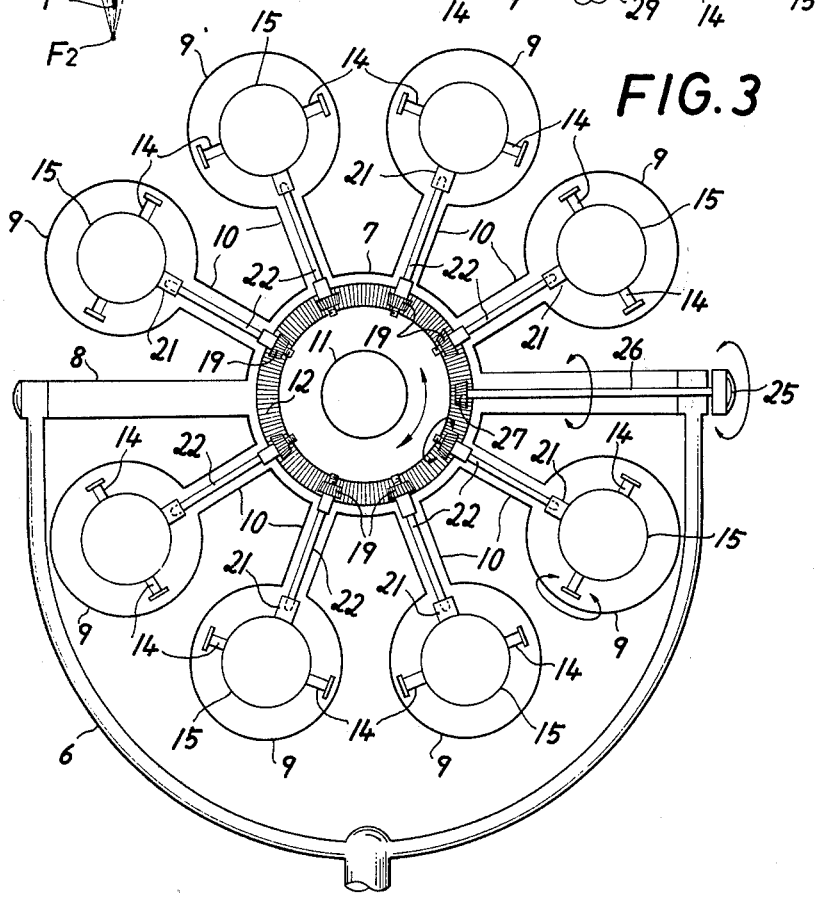
FIG. 3 is a diagrammatic plan view explaning the structure of a nine-lamp shadowless illumination system according to the invention.

In the four-lamp shadowless illumination system of FIG. 2, the mid-part of a straight lamp fitting pipe 30 is mounted on the ceiling or an appropriate stand by means of a tubular lamp housing holding arm 29 tiltably or rotatably mounted as shown in FIG. 1 and having a sleeve on the end thereof in which pipe 30 is journaled for rotation around the axis thereof. At both ends of said pipe 30 is mounted a lamp housing pipe 31, which together with the lamp fitting pipe 30 forms an H-shape pipe arrangement. On the end of each lamp housing pipe 31 is mounted a lamp housing 9 in the same way as described above in connection with FIGS. 1, 3, 4, 6, 7 and 8 at the center of pipe 30 at equal distances from all four lamps.

Within each lamp housing 9, the ends of each lamp-holder 15 are pivoted on pivot shafts 14 normal to the light axis. The remainder of the mounting arrangement of lamps 13 and springs 16 is the same as for the embodiment of FIGS. 1, 3, 5, 6, 7 and 8.

At a point on each lamp-holder 15 where the central axis of the lamp housing pipe 31 intersects, a bearing plate 21 is mounted, and against this plate bears one end of the operating rod 22, the other end of which is threaded into one end of the tubular screw gear 20 mounted on the center of a bevel gear 33, which in turn is rotated by a bevel gear 32 fixed to a rotatable shaft 26 within pipe 30 and rotated by the focus-adjusting knob 25 rotatably mounted on the exterior of one end of the lamp-fitting pipe 30. As with the corresponding rod 22 in the embodiment of FIGS. 1, 3, 5, 6, 7 and 8, this rod 22 is also prevented from rotating within the lamp housing pipe 31 and moves only linearly therein.

Figure 4:
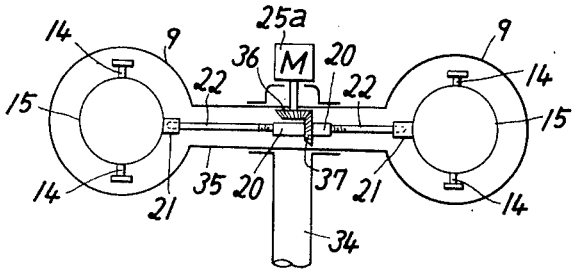
FIG. 4 is a diagrammatic plan view explaining the structure of a two-lamp shadowless illumination system according to the invention.
Figure 5:
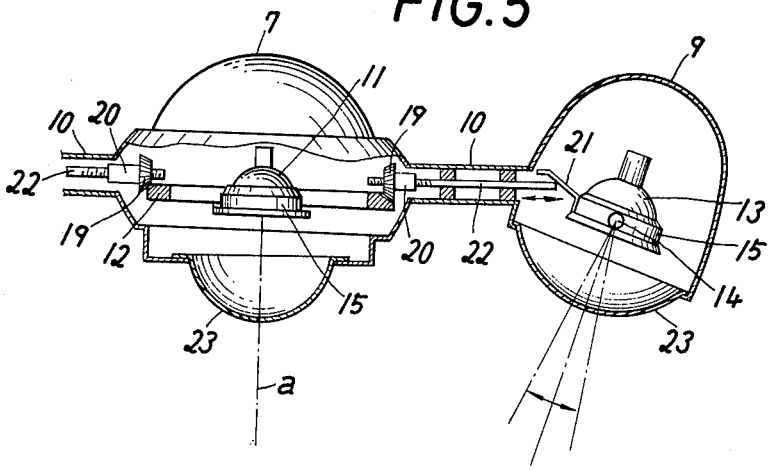
FIG. 5 is a partical sectional view illustrating the drive mechanism of the lamps in FIG. 3.
Figure 7:
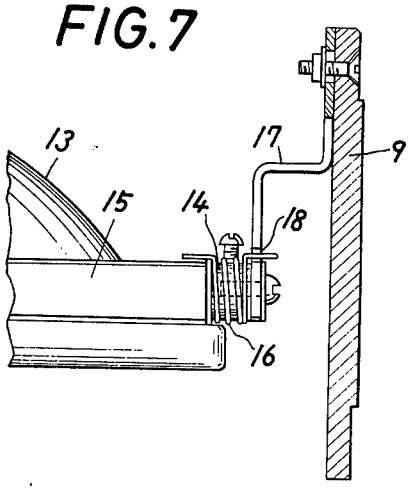
FIG. 7 is a partial sectional view showing the mounting of the lamp on the lamp housing.
Figure 8:
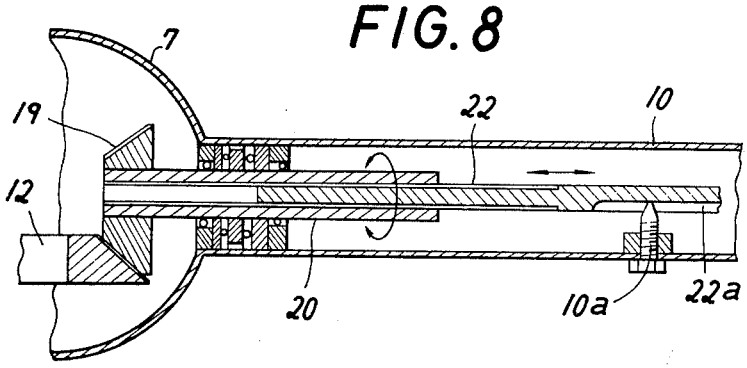
FIG. 8 is a partial sectional view showing the gear means for the drive mechanism shown in FIG. 5.

FIG. 4 shows an embodiment of a two-lamp shadowless illumination system in which the mid-part of a straight lamp fitting pipe 35 is rotatably journalled in a sleeve on the end of a holding arm 34 tiltably or rotatably mounted on the ceiling or any other appropriate stand. On both ends of pipe 35 is a lamp housing 9 tilted toward the light axis in the same way as described above for the other embodiments.

Within each lamp house 9 is lamp-holder 15 pivotally mounted on pivot shafts 14 in a direction normal to the light axis of the lamps, i.e., normal to the lamp fitting pipe 35. The remainder of the mounting arrangement of the lamps 13 and springs 16 is the same as for the embodiments described earlier.

At the position on each lamp-holder 15 where the central axis of the lamp fitting pipe 35 intersects is mounted a bearing plate 21. Against this plate 21 bears one end of an operating rod 22, the other end of which is threaded into a tubular screw gear 20 mounted on both sides of the center of a bevel gear 37 which in turn is rotated by a bevel gear 36. In this embodiment, bevel gear 36 is rotated by a focus-adjusting drive motor 25*a* mounted on the outside of the mid-part of the lamp fitting pipe 35. As in the other embodiments, the rod 22 is prevented from rotating within the lamp fitting pipe 35 and moves only linearly therein.

In the embodiments illustrated in FIGS. 2 and 4, the structure of the lamp housing 9 and the wiring means for the lamp 13 are the same as for the embodiment shown in FIGS. 1, 3, 5, 6, 7 and 8.

Likewise, in the embodiments illustrated in FIGS. 2 and 4, by turning the focus-adjusting knob 25 by switching the focus-adjusting drive motor 25*a* on and off, the operating rod 22 can be caused to make a linear movement by the rotation of the rotatable shaft 26, the bevel gears 32 and 33 and the tubular screw gear 20, or by the rotation of the bevel gears 36 and 37 and the tubular screw 20.

Thus, by the same operation as described above for the embodiment of FIGS. 1, 3, 5, 6, 7 and 8, the focus can be simply adjusted.

It can therefore be seen that the present invention permits adjustment of the depth of focus of a multi-lamp shadowless illumination system having sealed lamps by merely turning the focus-adjusting knob or switching of focus-adjusting drive motor on or off instead of moving the lamp housing and without causing any variance in the focus condition of each lamp.

Since the focus adjustment is made without moving the lamp housing and the lamp drive mechanism for this purpose is all within the illumination equipment, there is no likelihood of dust deposited on the surface of the lamp housing falling onto the illuminated surface. Thus the present invention, which improves the no-bacteria, no-dust condition in "clean air" medical treatment rooms, makes possible improved sanitation.

Since the operating rods for tilting the lamps are movable linearly through the lamp housing pipes, it is possible to make a lamp housing pipe of minimum diameter and accordingly minimize the top surface area, i.e., dust-collecting area, of the overall system, and this is further enhanced by the egg shape of the lamp housing.

Moreover, since the rotational movement of the focus-adjusting knob or the focus adjusting drive motor for driving the operating rod is converted through a screw gear to a linear movement, the position of the operating rod can be finely adjusted and accordingly a fine adjustment of each lamp is possible.

Since the operating rod is threaded into a screw gear and it cannot be moved directly by an external force, there is no likelihood of the accuracy of adjustment being lost or a variance being caused in the light field of each lamp even if a human hand happens to touch the lamp or the operating rod during maintenance or inspection of the system.

Since the lamp and the operating rod are held in contact with each other merely by the elasticity of a spring and they are not linked together, the lamp can be replaced by moving it away from the rod without injuring any mechanism or function. Thus the maintenance and inspection of the lamps are easy.

As seen from the above description, the focusing device for the multi-lamp shadowless illumination system having sealed lamps according to the present invention posseses a number of industrial advantages over the conventional single housing type or multi-lamp housing type of systems.

What is claimed is:

1. A multi-lamp shadowless illumination system comprising:

a plurality of sealed lamp housings and a lamp tiltably mounted in each lamp housing each lamp housing having spring means therein engaging the lamp therein for urging the lamp to tilt for moving the axis of the light beam from the lamp in one direction relative to said light axis;

a lamp holding pipe means on which said lamp housings are mounted in a generally horizontal array and in positions with the axes of the lamps directed toward a light axis depending perpendicularly from the central point of the array of lamp housings, said lamps within said housings being tiltable around axes which are perpendicular to said light axis;

operating rods movable linearly within said pipe means and a bearing plate on each lamp against which bears one end of said operating rod for tilting said lamp against the action of said spring means; and gear means coupled to said operating rods for driving said rods for simultaneously tilting said lamps to move the focal point of the beams of light from said lamps along said light axis.

2. The system as claimed in claim 1 wherein each of said sealed lamp housings is substantially egg-shaped.

3. The system as claimed in claim 1 wherein said gear means for driving said operating rods comprises at least one tubular screw gear within said lamp holding pipe means and into which the other end of the rods is threaded, at least one gear to which the tubular screw gear is connected, a further gear with which said one gear is meshed, and driving means for rotating said further gear.

4. The system as claimed in claim 3 in which said driving means is a manually operated knob and a shaft coupled to said further gear.

5. The system as claimed in claim 3 in which said driving means is a motor means coupled to said further gear and having switch means for turning the motor on and off.

6. The system as claimed in claim 3 in which said operating rod has a key groove along the length thereof and a key is provided in said pipe means and engaged in said key groove for preventing the operating rod from rotating within said pipe means.

7. The system as claimed in claim 3 in which said tubular screw gear is mounted on the center of said at least one gear.

8. The gear system as claimed in claim 3 in which there is a tubular screw gear for each of said operating rods and a gear for each of said operating rods on which said tubular gear is centrally mounted, and said further gear is a single gear with which all of the first-mentioned gears are meshed.

* * * * *